US006540637B2

(12) United States Patent
Bachmann et al.

(10) Patent No.: US 6,540,637 B2
(45) Date of Patent: Apr. 1, 2003

(54) TOOTHED ROTOR SET

(75) Inventors: Josef Bachmann, Obersinn (DE); Harald Neubert, Monheim (DE); Eberhard Ernst, Eichenzell (DE)

(73) Assignee: GKN Sinter Metals GmbH (DE)

( * ) Notice: Subject to any disclaimer, the term of this patent is extended or adjusted under 35 U.S.C. 154(b) by 0 days.

(21) Appl. No.: 10/053,927

(22) Filed: Nov. 19, 2001

(65) Prior Publication Data

US 2002/0159905 A1 Oct. 31, 2002

Related U.S. Application Data

(63) Continuation of application No. PCT/EP00/04474, filed on May 17, 2000.

(30) Foreign Application Priority Data

May 18, 1999 (DE) ..... 199 22 792

(51) Int. Cl.[7] ..... F16H 1/32

(52) U.S. Cl. ..... 475/162

(58) Field of Search ..... 475/162, 180; 418/61–3

(56) References Cited

U.S. PATENT DOCUMENTS 3,917,437 A * 11/1975 Link ..... 415/125
5,595,479 A 1/1997 Hansen et al. ..... 418/61.3

FOREIGN PATENT DOCUMENTS

DE 196 46 359 5/1998

* cited by examiner

*Primary Examiner*—Dirk Wright
(74) *Attorney, Agent, or Firm*—Woodcock Washburn LLP

(57) ABSTRACT

The invention relates to a toothed rotor set for a pump, especially for a lubricating oil pump for internal combustion engines, wherein the toothed rotor set has a toothed configuration similar to a toothed ring pump and functioning and operation of said toothed rotor set corresponds to that of a toothed ring pump.

13 Claims, 7 Drawing Sheets

TOOTHED ROTOR SET

RELATED APPLICATIONS

This Application is a continuation of International Application No. PCT/EP00/04474 filed May 17, 2000 which claims priority to German Application No. 199 22 792.6 filed May 18, 1999.

BRIEF DESCRIPTION OF THE INVENTION

This application is in English. The invention concerns a toothed rotor set for a pump, especially for a lubricating oil pump for internal combustion motors. The toothed rotor is similar to a toothed ring pump with toothed construction whereby the function and mode of action of a toothed rotor set corresponds to that of a toothed ring pump.

With toothed ring pumps, the pressure chamber is not separated from the suction chamber by a sickle-shaped filling element, but rather a special construction of the teeth-based upon trochoid gearing-guarantees the sealing between toothed ring and outer geared pinion. The internal geared toothed ring possesses one gear more than the pinion so that with corresponding configuration of the gears, the gear tips touch precisely over against the gear engaging point. In order that a rolling off is guaranteed, a tip play between the gear tip of the outer rotor and gear tip of the internal rotor must be present. The disadvantage of toothed ring pumps is that, owing to this tip play, internal leakages and consequently a poor volumetric degree of efficiency occurs. Owing to this, no high pressures can be built up at low rotational speeds.

More advantageous in comparison with toothed ring pumps is a pump according to the theory of DE-A-196 46 359. The pump forms a representative toothed rotor set consisting of an outer ring with an internal gearing and an eccentrically accommodated gear wheel with external gearing, whereby the internal gearing is formed by pivoted rollers in the outer ring and has one tooth more than the outer gearing, whereby the outer gearing of the gear wheel is a fine gearing with a basically smaller module superposed, and each roller has on its periphery a fine gearing with the same module into which the teeth of the geared wheel engage.

The function of the toothed rotor set becomes apparent in that a drive factor operates through a drive shaft on the inner rotor and rotates this. From the geared inner rotor, a force is transmitted to the planet pinion which on the one hand provides an impulsive force through the center of the planet rotor and a peripheral force which brings about a torque of the planet rotor. Owing to the impulsive force which acts on the ring bearing, this is put into rotation.

The forces and torque arising can not be optimally accommodated with the representative toothed rotor set through the previously used involute toothed system. There in particular exists the problem that the known gearing does not transmit the impulsive and peripheral forces without great surface pressure in the form of a linear contact. The previously known gearing systems are only suitable for the transmission of high peripheral forces and not for the transmission of great impulsive forces which run through the center of the planet rotor.

The model toothed rotor set proves to be disadvantageous in that a clean rolling out is not guaranteed under all operating conditions without engagement disturbances. The motion of the planet rotors relative to the ring bearing comes to a standstill in one position.

In this state in which the planet rotor almost stands still and at the same time a great force is transmitted, there exists the danger that the lubricant film between planet gear tip and outer rotor will break down, owing to which the Couette flow is brought to a standstill. Here a solid body contact arises through the loss of lubricant in the gap. There consequently no longer exists a favorable hydrodynamic lubrication but rather mixed friction states and in unfavorable cases a static friction. In the event of mixed and static friction, wear and tear phenomena arise and the service life of the toothed rotor set is reduced.

From U.S. Pat. No. 5,595,479, a hydraulic machine is known which is constructed from a rotable ring bearing with bearing pockets, whereby pivoted rollers with recesses are arranged in the bearing pockets on the peripheral surface, with an inner rotor mounted eccentrically toward the bearing ring with approximately star-shaped outer contour, whereby the points of the stars engage into the recesses of the rollers. The rollers and the inner rotor do not have the fine gearing of the invention, owing to which especially with toothed gear sets with a higher number of gear teeth, for example 11/12, engagement disturbances arise. The construction is only capable of running with very small tolerances.

From the disadvantages of the known state of the art, there results the objective of creating a toothed rotor set which is configured such that a lasting lubricant film structure for avoiding unfavorable friction states is guaranteed, whereby the toothed rotor set must safely transmit the forces and torque arising.

The object is accomplished in accordance with the invention though a toothed rotor set consisting of a rotatable ring bearing with bearing pockets in which pivoted planet rotors are arranged which form an inner gearing with an internal motor mounted eccentrically toward the ring bearing with approximately star-shaped outer contour which is provided with an outer contour, whereby the outer gearing has one tooth less than the inner gearing, and the gearing system of at least one of the two rotor systems has in part regions of the tooth form of the bearing an arch-like component. The advantage of a toothed rotor set configured in this way consists in that through the arch-like component in the tooth form, a rolling friction and no sliding friction occurs, so that the wear and tear on the gearing is minimized. Owing to the convexly constructed gear tooth tip of the geared internal rotor and the concavely constructed gear tooth root, there arises a contact surface and not a contact line. The Hertzian pressing is very greatly reduced through this roller pairing.

This also applies for the gear tooth flanks of the geared inner rotor and the geared planet rotor. By incorporating a flank play between the gear tooth of the planet rotor and the tooth gap of the inner rotor, it is guaranteed that the great impulsive forces are only transmitted through the gear tip and the gear tooth root. In this way, the action of great wedge forces acting on the gear tooth flanks is prevented, which can lead to the destruction of the flank surfaces. In addition, the flow medium can flow out of the gear tooth gaps owing to the flank play, as otherwise oil compression can arise which can lead to a very high pressure build up.

It is provided in an advantageous configuration of the invention, that the shape of the gear tooth is constructed arch-like in the region of the gear tooth tip and/or the gear root. Such a configuration of the tooth shape in the region of the gear tooth tip and/or the gear root makes it possible to be able to transmit very large impulsive forces (radial forces), whereby the portion of the peripheral force to be transmitted can be very small. In this connection, the gear tooth tip and the gear root are, in contrast involute toothed gear systems known in connection with toothed rotors, incorporated into the rolling off process, that is the hobbing of the geared planet rotor on the geared inner rotor curve.

The convexly curved gear tooth flank of the planet rotor and the concavely curved tooth flank of the inner rotor form a relatively large sealing area upon gear engagement which seals off the displacer chamber when the displacer chamber passes over from the suction region into the pressure region. Even deviations in the perpendicularity of the rotor do not lead to leakage losses of the displacer chamber.

It is provided in an advantageous configuration of the invention that especially [in] the region of the gear tooth tip and/or the gear foot, the gear tooth shape has a flattening. In the main zone of force transmission, in which the torque acts on the ring bearing through the geared inner rotor through the geared planet rotor, a standstill of the planet rotor almost occurs, geometrically conditioned. With the relative standstill described and the simultaneous transmission of a great force, there exists the danger that the lubricant film will break down between the planet tooth tip and the ring bearing ring. In order to counteract this, the planet rotor gear tooth tips were flattened. The magnitude of the flattening depends upon the usable area of the toothed rotor. At low rotational speeds and high pressures, a great flattening is necessary. At great rotational speeds and low pressures, a small flattening is necessary to guarantee a lubricating film build up even at low sliding speeds. For the transmission from the gear tooth tip of the planet rotor to the flattening, a special curve, a cycloid, is used, which more strongly promotes the lubricant film build up than a simple transition radius.

In a further advantageous configuration of the invention, it is provided that in particular in the region of the gear tooth tip and/or the gear toot, the shape of the tooth has a great curvature radius. Instead of a flattening, it is also appropriate to provide, in the region of the gear tooth tip and/or gear foot, a surface with a large curvature radius.

By flattening the planet rotor gear tooth tips, an improvement of force transmission (Hertzian pressing) by the planet rotor on the ring bearing is brought about.

In an especially advantageous configuration of the invention, it is provided that the arch-like component is constructed at least partially as a cycloid. The cycloid has proven to be especially advantageous in relation to the rolling off behavior and the transmission of impulsive forces. This cycloid gearing guarantees, even with considerable changes in curvature and small curvature radii, a trouble-free low-sliding rolling off which once again reduces wear and tear.

It is provided in an appropriate construction of the invention that at least in the region of the gear tooth flanks, the shape of the teeth is constructed as involuted. With this gearing system, the gear tooth flanks of the toothed inner rotor and the outer geared planet rotor are formed by an involute, whereby nevertheless in this embodiments, engagement disturbances can arise more easily that with an embodiment whose gear teeth flanks are constructed as cycloids.

It is provided in an advantageous configuration of the invention that the gearing has a low wear and tear surface. The low wear and tear surface can be obtained by a chemical, especially thermo-chemical and/or physical surface treatment. The surface can furthermore also be galvanized. Further advantageous surface treatment procedures are carbureting, nitrification and/or nitrocarbureting, borification and/or chrome sensitization.

It is provided in an appropriate configuration of the invention that, in the region of bearing pockets, at least one fluid channel is arranged. The fluid channel can be connected with the pump with the pressure side so that lubricating oil is continuously fed between planet rotor and bearing pocket in order to guarantee improved lubricating film build up.

Advantageously all moving parts of the toothed rotor set, especially the ring bearing and/or the planet rotors and/or the inner rotor have at least one circular bar on a face. This circular bar serves as sealing inside the housing in which the toothed rotor set is accommodated. Usually such moving parts have a sealing surface on their front sides which extend over their entire surface with exception of the gearing. This sealing of the invention by means of a circular bar has the advantage that the high friction forces arising with the known seals are strongly diminished and thus the toothed rotor set operates easier and therewith more efficiently. At the same time, the circular bar has a width which represents the optimum between sealing action and friction force.

Finally, the invention concerns a process for manufacturing a gearing rotor set whereby this is manufactured in a shaping process, preferably using a powder metallurgical process, plastic injection molding, cold forging, die casting, especially aluminum die casting, and stamping processes. An expensive gearing such as the toothed rotor set of the invention has can be produced simply and economically by means of this process. A filing and sawing, which as is well known is used with the usual gearing systems, can have no application in the present invention as the gearing for this is constructed in an excessively complicated manner.

In an advantageous configuration of the invention, it is provided that the toothed rotor set is used in a pump, especially a lubricating oil pump for internal combustion motors.

In a further advantageous configuration of the invention, it is provided that the toothed rotor set is used as a motor.

BRIEF DESCRIPTION OF THE DRAWINGS

The invention is explained in greater detail on the basis of schematic drawings, wherein.

DETAILED DESCRIPTION OF THE INVENTION

Figure 1:
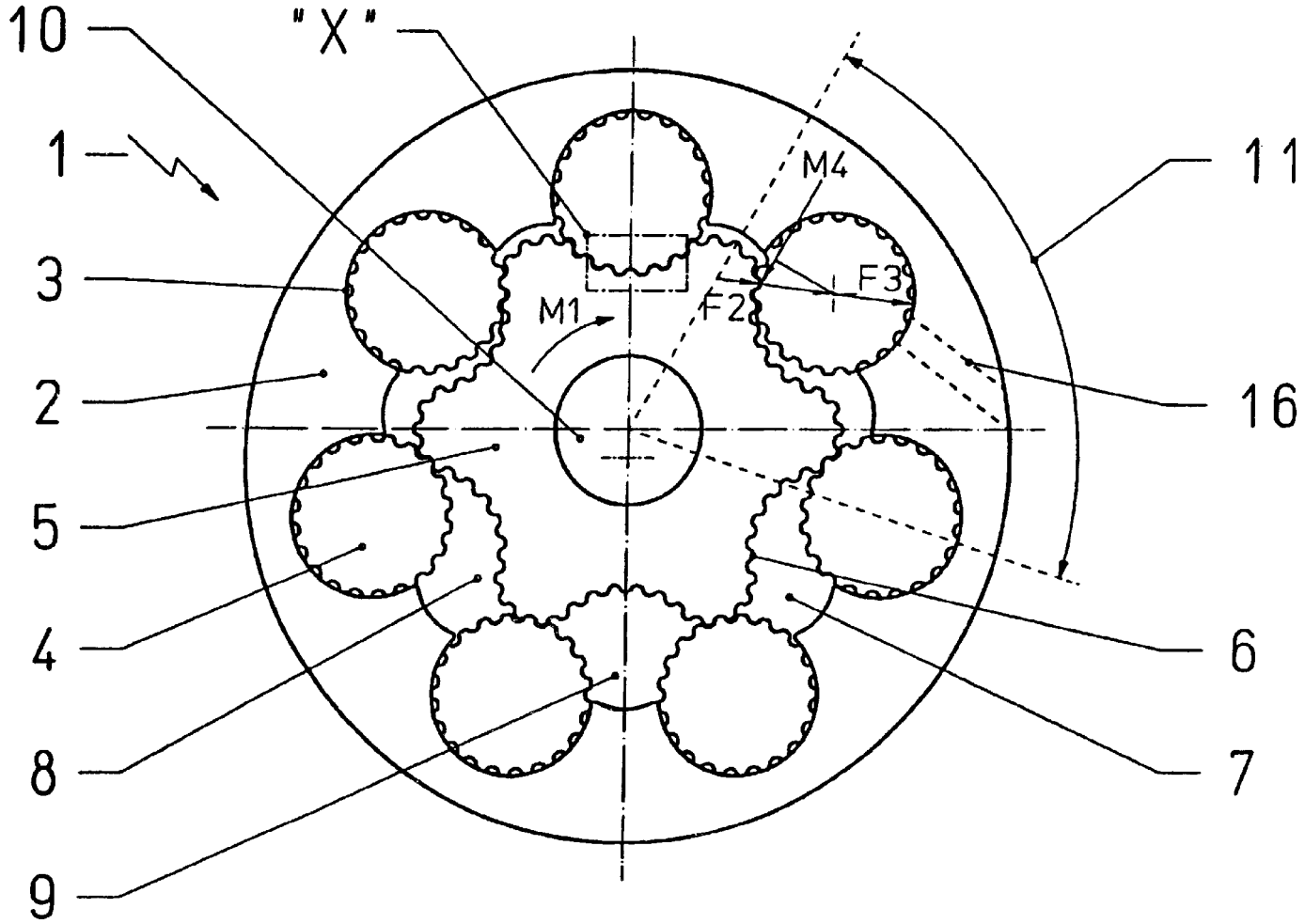
FIG. 1 Depicts a toothed rotor set.

FIG. 1 shows a toothed rotor set 1 of the invention consisting of a rotatable ring bearing 2 with bearing pockets 3 in which pivoted planet rotors 4 are arranged, which form an inner gearing with an inner rotor 5 mounted eccentrically in relation toward the ring bearing 2 with an approximately star-shaped outer contour which is provided with an outer gearing system 6, whereby the outer gearing 6 has one gear tooth less than the inner gearing.

The toothed rotor set 1 has a suction area 7, a pressure area 8 and a displacer chamber 9.

Through drive shaft 10, a starting torque M1 acts on the toothed inner rotor 5. A peripheral force F2 acts from the toothed inner rotor 5 on the geared planet rotor 4 which is mounted in a ring bearing 2 (housing). The peripheral force F2 is divided into two components, the impulsive force (radial force) F3 and the torque M4 which both act upon the planet rotor. The impulsive force F3 acts through the center of the toothed planet rotor 4 which is mounted in a ring bearing 2 and sets the ring bearing 2 in rotation. Through torque M4, the toothed planet rotor is set into motion.

The toothed rotor set 1 of the invention can be used as a pump for generating pressure since the inner rotor 5 is driven through a drive shaft 10. On the other hand, the toothed rotor set 1 can also be used as a motor in that the pressure region is acted upon by pressure so that the inner rotor 5 is set into rotation and the drive shaft 10 drives.

In the main force transmission zone 11 in which the torque acts through the toothed inner rotor 5 through the geared planet rotor 4 on the ring bearing, things almost come, geometrically conditioned, to a standstill of the planet rotor 4. With the relative standstill described and the simultaneous transmission of a large force, there exists the danger that the lubricating film between planet gear tooth tip 11 and ring bearing 2 breaks down.

Figure 1A:
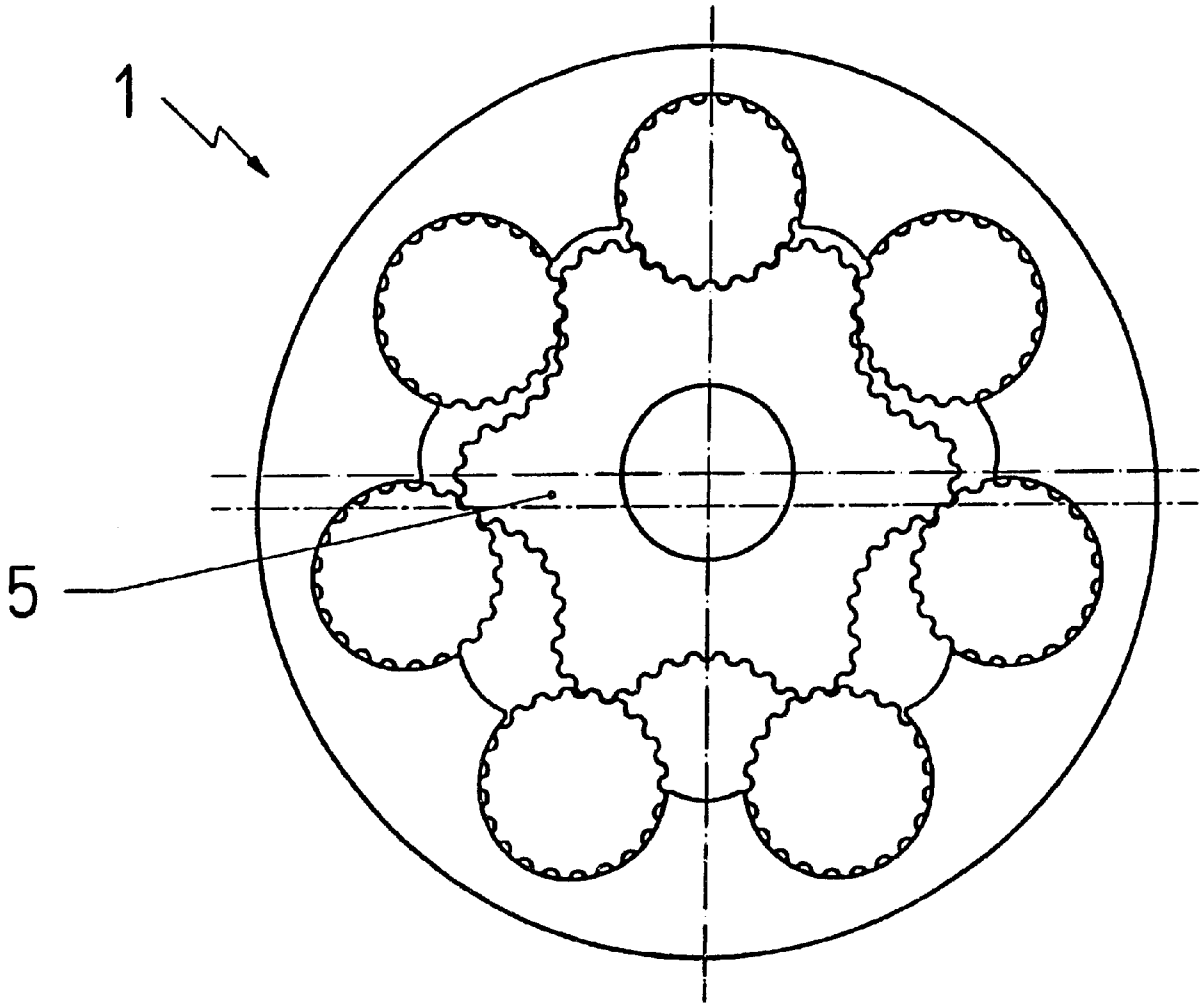
FIG. 1*a* Shows the toothed rotor set in a second operating position

FIG. 1*a* shows the toothed rotor set 1 in a second operating position. In this, a maximal pressure is generated since the inner rotor acts maximally on the planet rotors 4.

Figure 1B:
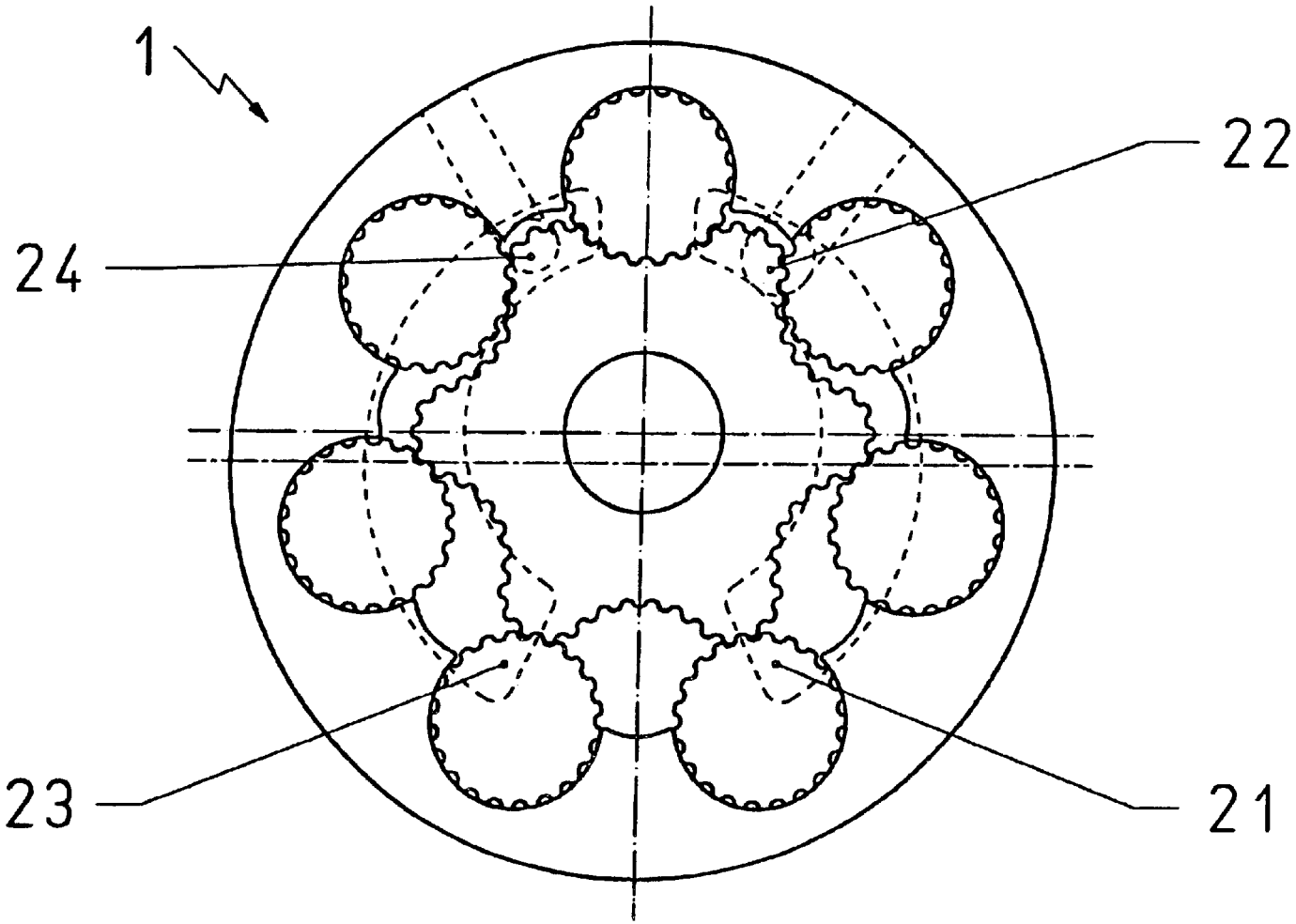
FIG. 1*b* Provides a view of the toothed rotor set with suction side and pressure side, FIG. 2 Illustrates a variant I of the gearing of the invention in accordance with detail "X" in FIG. 1, FIG. 3 Depicts a variant II of the gearing of the invention FIG. 4 Shows a variant III of the gearing of the invention FIG. 5 Is a representation of the parameters used for calculating the gearing.

FIG. 1*b* shows a view of the toothed rotor set 1, whereby a suction side 21 as well as a pressure side 23 are depicted. An inlet opening 22 opens into the suction side 21 which by way of example can be constructed laterally as a bore hole into the housing accommodating the toothed rotor set. Likewise, an outlet opening 24 opens into the pressure side 23. The diameter of the outlet opening 24 is smaller than that of the inlet opening 22, since with the latter a higher rate of flow exists.

Figure 2:
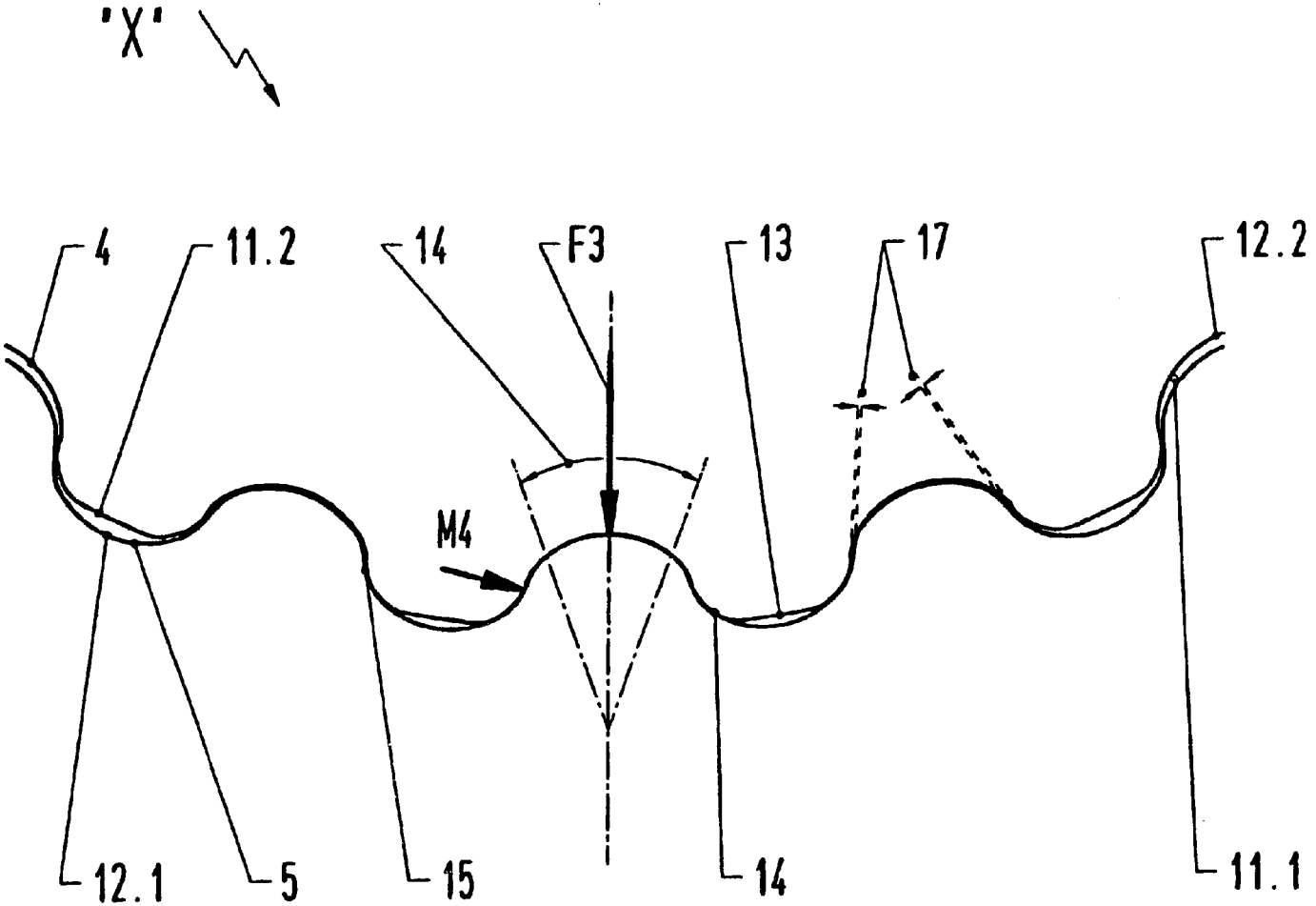

FIG. 2 depicts a variant I of the gearing system of the invention in accordance with detail "X" in FIG. 1. The large impulsive force F3 (radial force) represented in FIG. 1 and the but small peripheral force F4 must be transmitted. With this gearing system, gear tooth tip 11 and gear root 12 are incorporated into the rolling off process, that is the hobbing of the toothed planet rotor 4 on the geared inner rotor curve. With the gearing system represented in FIG. 2, the surface components of the gearing are selected such that they correspond to the force breakdown.

The largest component, the arch-like component 14, of the gearing system consequently consists in the gear root 12 and gear tooth tip 11, which transmit the impulsive force F3 between the geared inner rotor 5 and the toothed planet rotor 4. Only a small portion of the gearing surfaces consists of sliding surfaces in the area of the gear tooth flanks 15, which transform the peripheral force F4 into a rotation motion of the geared planet rotor 4.

Gear tooth tip 11.1 of the toothed inner rotor 5 is calculated such that it lies exactly in the gear root 12.1 of the geared planet rotor 4 and guarantees a problem-free rolling off. Conversely the gear tooth tip 11.2 of the toothed planet rotor 4 engages in the gear root 12.1 of the geared inner rotor 5. In this connection, through the convexly configured gear tooth tip 11.1 of the toothed inner rotor 5 and the concavely constructed gear root 12.2 of the geared planet rotor 4, a contact surface arises and not a contact line. By this roller pairing, the Hertzian pressing is therefore greatly reduced.

This also applies for the gear tooth flanks of the toothed inner rotor 5 and the geared planet rotor 4. By incorporating a flank play 17 between gear tooth of the planet rotor 4 and gear tooth gap of the inner rotor 5, it is guaranteed that the great impulsive force F3 is transmitted only through gear tooth tip 11 and gear root 12. In this way the action of wedge forces on the gear tooth flanks is prevented which can lead to destruction of the flank surface. In addition, through the flank play 17, the flow medium can flow out of the gear tooth gaps, as otherwise oil compression would occur, which can lead to a very high pressure build up.

Figure 3:
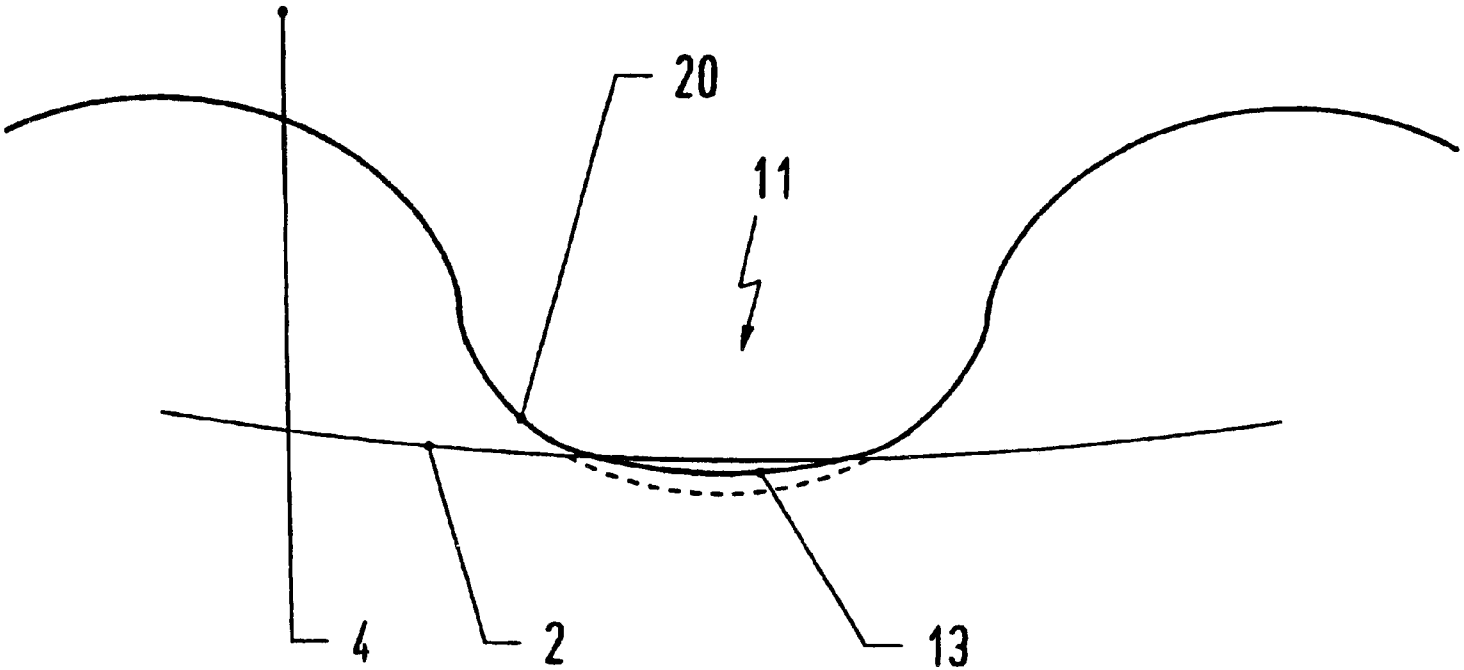

FIG. 3 illustrated a second variant of the gearing of the invention. With the relative standstill of the planet rotors 4 described above and the simultaneous transmission of a large force, there exists the danger that the lubricant film between planet gear tooth tip 11 and ring bearing 2 will break down. This is prevented in that the planet rotor gear tooth tips 11 are flattened. The size of the flattening 13 depends on the usable area of the toothed rotor. At slow rotational speeds and high pressures, a great flattening 13 must be provided. At a great rotational speed and low pressures, a moderate flattening 13 suffices in order to build up a continuous lubricant film. For the transition from gear tooth tip 11 of the planet rotor 4 to flattening 13, a cycloid 20 was used which more strongly favors the lubricant film build up than a simple transition radius.

Owing to the flattening 13 of the planet gear tooth tips 11, an improvement of force transmission (Hertzian pressing) from the planet rotor 4 to the ring bearing 2 is brought about.

Figure 4:
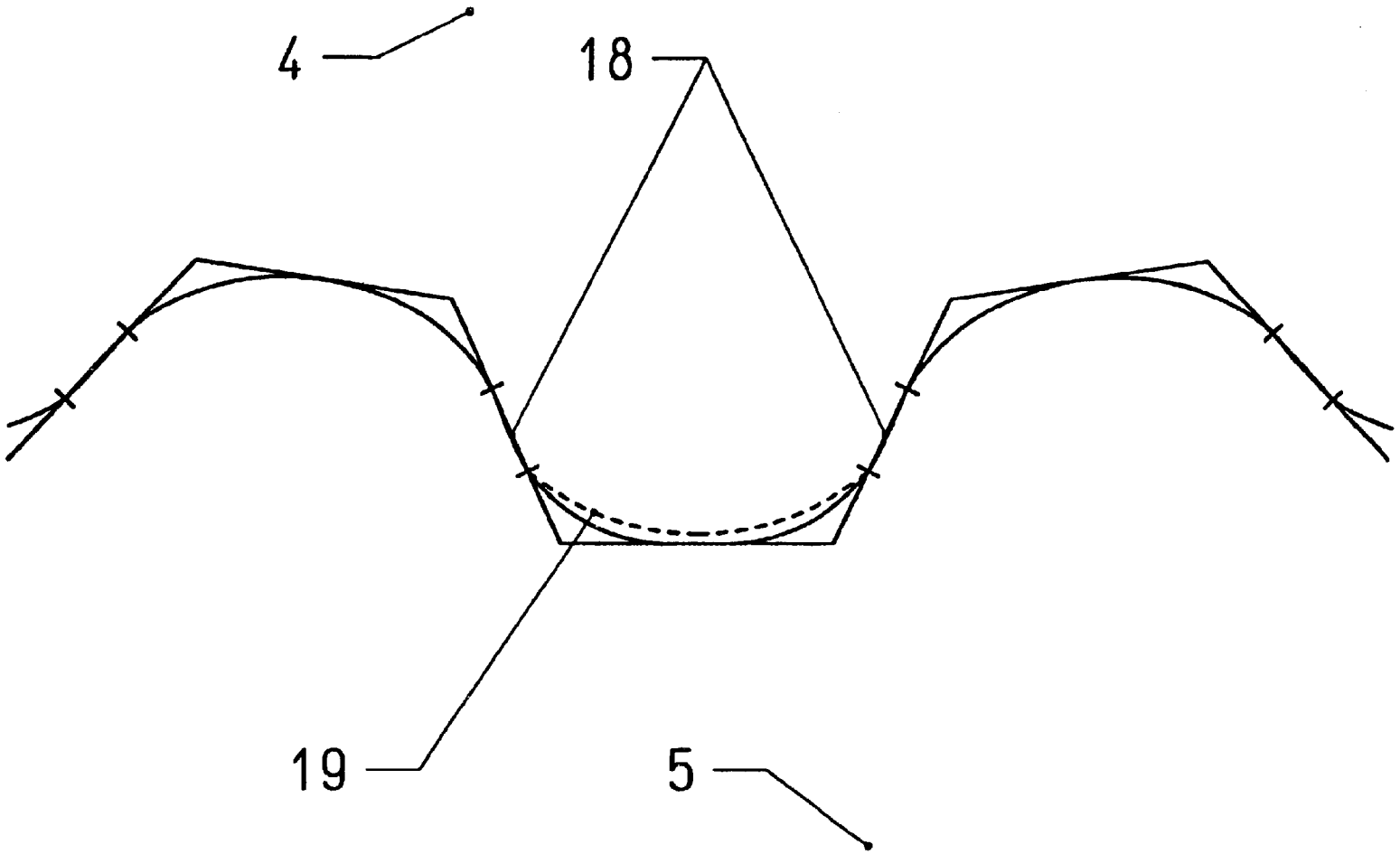

FIG. 4 shows a third variant of the gearing of the invention whereby the gear tooth flanks 15 of the toothed inner rotor 5 and the geared planet rotors 4 are formed by an involute 18. The gear tooth tip of planet rotor 4 is in contrast constructed as cycloid 19. With this embodiment, there nonetheless exists a greater probability that engagement disturbances will arise.

Furthermore, all known gearing system types are only suited for the transmission of peripheral forces (torques), for example with gear drives. With almost all drives, outside of gears with periodically variable translations (elliptical gears), the gears are positioned in a fixed manner by the distance from the axle. The peripheral forces are transmitted only through the gear tooth flanks, which touch in rolling point C. With all these rolling processes, gear tooth tip and gear root are excluded from rolling out processes.

With all known gearing types, only conditionally small or medium sized radial forces can be transmitted. If radial forces act upon a pair of gears, the gear tooth of wheel 1 is pressed like a wedge into the gear tooth gap of wheel 2 owing to which a very large flank pressing arises, owing to which premature wear and tear or breakage of the gear tooth can arise.

This problem is solved by incorporating the root and gear tooth tip into the rolling off process. The radial forces (impulsive force F3) are in this case only transmitted through the root and tooth gear tip. Through a special design of the foot and gear tooth tip through which the convexly curved gear tooth tip 11 comes into engagement with a concavely curved gear root 12, it is possible to reduce flank pressure by up to 80%.

Figure 5:
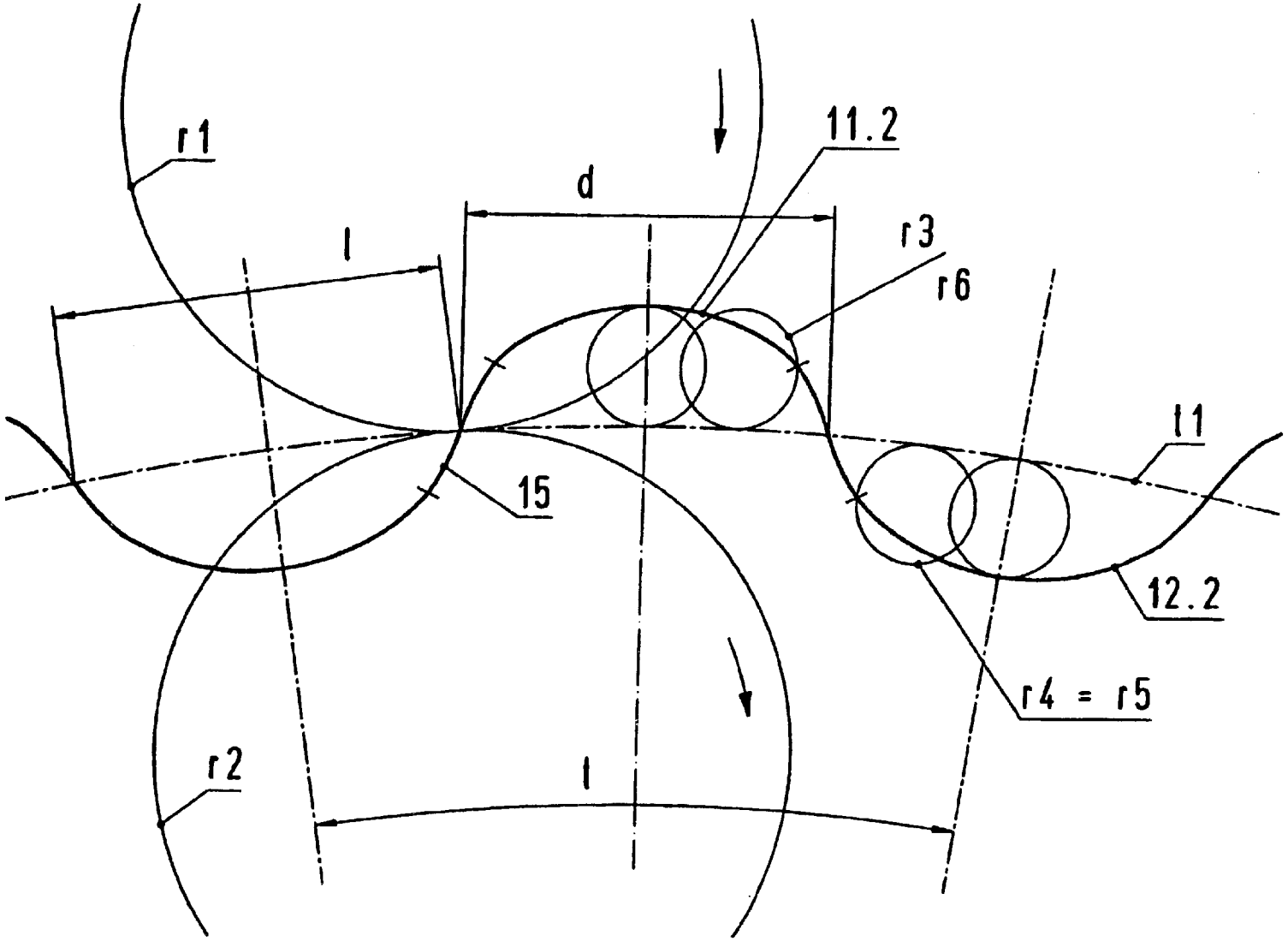

In accordance with FIG. 5, the stress on the contact line of the gear tooth flanks is by way of replacement computed as pressure stress of two parallel rollers which agree with the gear pairing in the following points: Length b of the contact line, curvature radii r1 and r2 in the normal section plane toward the contact line, material pairing and surface quality (r1 and r2 are measured on the contact point of the unstressed flanks).

For roller pairings of this type, FIG. 2 is the amount of stress related (k value according to Stribeck).

$K=P/2*r*b$ (kg/mm2).

In this connection r=r1*r2/r1+r2 for concave flanks, r2 must be set negatively.

Calculation of Gear Tooth Flanks (Cycloid)

Only a small part of gearing system geometry consists of sliding surfaces which transform the peripheral force F4 into a rotatory motion of the toothed planet rotor 4, whereby the size of the gear tooth flank is dependent on the usable area of the wheel set.

The gearing of the planet rotor 4 is designed as zero gearing and that of the inner rotor 5 entails a negative profile shift.

Calculation of the planet rotor 4

Divided circle 1 (*t*1)=rolling circle of planet rotor 4

Module=divided circle 1 (t1)/number of gear teeth of planet rotor 4

Gear tooth thickness=module*π/2

Generation of gear tooth flanks 15

Rolling circle 1 (*t*1)=rolling circle 2 (*r*2) divided circle (*t*1)1*0.3

Gear root and tooth gear tip design of planet rotor 4

Rolling circle 3 (r3) of gear tooth tip 11.2 (epi-cycloid); rolling circle 4 (r4) of gear tooth tip 12.2 (hypo-cycloid)

Division *t*=divided circle 1*π/gear teeth number of planet rotor 4

Rolling circle 3 (r3)=rolling circle 4 (r4)=t/2/π

Inner rotor 5 calculation

Divided circle 2 (*t*2)=rolling circle of inner rotor curve 5 (coarse gearing)

Division t=periphery (inner rotor curve 5)/number of gear teeth

Gear tooth thickness d=(t/2−2*flank play)

Gear tooth thickness 1=(t/2+2*flank play)

Generation of the Gear Tooth Flanks

Generation as with planet rotor 4 but independently of the size of the variable rolling circle.

Gear root-tooth gear tip design of the inner rotor

Rolling circle 5 (*r*5)(gear root 12.1)=(*t*/2+2*flank play)π

Rolling circle 6 (*r*6)(gear tooth tip 11.1)=(*t*/2−2*flank play/π

In FIG. 4, only the gear tooth flanks are designed as involutes, all other calculation magnitudes agree with the calculation presented above.

Owing to this design of the gearing, the curvature relationships between gear tooth tip 11 and gear root 12 (convex, concave) are very similar, owing to which a pure surface contact almost occurs, and Hertzian pressing is consequently reduced. Furthermore, with this optimized design in the rolling process, the additional sliding motion (tangential friction) is very slight.

The gearing system of the invention can also be used in connection with elliptical wheels, generally out of round wheels and Root's blowers.

What is claimed is:

1. A toothed rotor set, comprising (i) a rotatable ring bearing having a pocket formed therein, (ii) a pivotable planet rotor disposed in the pocket and having an inner gearing formed thereon, the inner gearing comprising a first plurality of gear teeth and (iii) an inner rotor mounted eccentrically with respect to the ring bearing and having a contoured outer surface, the outer surface being substantially star-shaped and having an outer gearing formed thereon, the outer gearing comprising a second plurality of gear teeth, wherein the second plurality of gear teeth is one less in number than the first plurality of gear teeth and at least one of the first and second pluralities of gear teeth have an arched portion being substantially shaped as a cycloid.

2. The toothed rotor set according to claim 1, wherein the arched portion is located proximate at least one of a tip and a root of least one of the first and second pluralities of gear teeth.

3. The toothed rotor set according to claim 2, wherein roots of the at least one of the first and second pluralities of gear teeth are each shaped substantially as a hypocycloid and tips of the at least one of the first and second pluralities of gear teeth are each shaped substantially as an epicycloid.

4. The toothed gear set according to claim 1, wherein flanks of at least one of the first and second pluralities of gear teeth are shaped substantially as a cycloid.

5. The toothed rotor set according to claim 1, wherein the planet rotor is constructed in accordance with the following formulae:

a divided circle 1 (*t*1)=a rolling circle of the planet rotor;

a module=the divided circle 1 (*t*1)/a total number of the first plurality of gear teeth;

a thickness of the first and second pluralities of gear teeth=the module*π/2;

a rolling circle 1 (*r*1)=a rolling circle 2 (*r*2)=the divided circle 1 (*t*1)*0.3;

a division *t*=the divided circle 1 (*t*1)*π/the total number of the first plurality of gear teeth;

and a rolling circle (*r*3) of tips of ones of the first and second pluralities of gear teeth having a substantially epi-cycloidal shape=a rolling circle 4 (*r*4) of tips of ones of the first and second pluralities of gear teeth having a substantially hypo-cycloidal shape=the division *t**π/2.

6. The toothed rotor set according claim 1, wherein the inner rotor is constructed in accordance with the following formulae:

a divided circle 2 (*t*2)=a rolling circle of an inner rotor curve (coarse gearing);

a division *t*=a periphery (inner rotor curve)/a total number of the second plurality of gear teeth;

a gear tooth thickness *d*=(the divided circle 2 (*t*2)−2*a flank play)

a gear tooth gap 1=(the divided circle 2 (*t*2)+2*the flank play)

a rolling circle 5 (*r*5)=(the divided circle 2 (*t*2)+2*the flank play)/π a rolling circle 6 (*r*6)=(the divided circle 2 (*t*2)−2*the flank play)/π.

7. The toothed gear set according to one of claim 1, wherein flanks of at least one of the first and second pluralities of gear teeth each have a substantially involute shape.

8. The toothed gear set according to claim 1, wherein at least one of a root and a tip of at least one of the first and second pluralities of gear teeth has a large-curvature radius.

9. The toothed gear set according to claim 1, wherein at least one of a root and a tip of at least one of the first and second pluralities of gear teeth has a substantially flat portion.

10. The toothed gear set according to claim 1, wherein each of the first and second pluralities of gear teeth has a low wear and tear surface.

11. The toothed gear set according to claim 1, further comprising a fluid channel located proximate the bearing pocket.

12. The toothed gear set according to claim 1, farther comprising a substantially circular bar disposed on a face of a least one of the ring bearing, the planet rotor, and the inner rotor.

13. The toothed gear set according to claim 1, wherein the plant rotor and the inner rotor are manufactured using one of a powder metallurgical process, plastic injection molding, cold forging, die casting, and stamping.

* * * * *